US005822825A

United States Patent [19]

West

[11] Patent Number: 5,822,825

[45] Date of Patent: Oct. 20, 1998

[54] WINDOW ICE SCRAPER

[76] Inventor: Eric A. West, 2040 Hatfield Rd., Huntington, Md. 20639

[21] Appl. No.: 998,459

[22] Filed: Dec. 26, 1997

[51] Int. Cl.[6] ..... A47L 1/06

[52] U.S. Cl. ..... 15/236.02; 15/236.01; 15/236.05; 30/169; D32/46

[58] Field of Search ..... 15/236.01, 236.02, 15/236.05, 236.06, 236.07, 236.08, 236.09; 30/169; D32/40, 46; D8/45

[56] References Cited

U.S. PATENT DOCUMENTS

| | | | |
|---|---|---|---|
| D. 269,944 | 8/1983 | Young | D32/46 |
| D. 301,973 | 7/1989 | Parella | D32/46 |
| D. 312,155 | 11/1990 | Saunders | D32/46 |
| D. 392,078 | 3/1998 | Courts | D32/46 |
| 969,528 | 9/1910 | Disbrow | 30/169 |
| 3,408,677 | 11/1968 | Yates | 15/236.01 |
| 3,816,863 | 6/1974 | Thielemann, Jr. | 15/236.01 |
| 3,865,370 | 2/1975 | Rogers | 30/169 |
| 4,495,670 | 1/1985 | Baker | 15/236.02 |
| 4,788,770 | 12/1988 | Simard | 30/169 |
| 5,099,540 | 3/1992 | Paschetto | 15/236.02 |

FOREIGN PATENT DOCUMENTS

| | | | |
|---|---|---|---|
| 2436697 | 5/1980 | France | 15/236.02 |

*Primary Examiner*—Randall E. Chin
*Attorney, Agent, or Firm*—Michael I. Kroll

[57] ABSTRACT

A window ice scraper (10) comprising a one-piece flat plate (12) having a scraping edge (14). A facility (16) in the one-piece flat plate (12), is for securely grasping by a hand (18) of a person (20). It will reduce strain on the wrist (22) of the person (20), while the scraping edge (14) on the one-piece flat plate (12) can effectively remove ice (24) from a flat surface (26), such as a window in an automobile.

7 Claims, 5 Drawing Sheets

WINDOW ICE SCRAPER

BACKGROUND OF THE INVENTION

1. Field of the Invention

The instant invention relates generally to cleaning instruments and more specifically it relates to a window ice scraper. The window ice scraper is a one-piece triangular shaped flat plate having a V-shaped scraping edge, which can be securely grasped by a hand of a person. It will reduce strain on the wrist of the person and effectively remove ice from a window.

2. Description of the Prior Art

Numerous cleaning instruments have been provided in prior art. For example, U.S. Pat. No. 3,408,677 to Yates; 3,816,863 to Thielemann, Jr.,; 5,099,540 to Paschetto and Des. 269,944 to Young all are illustrative of such prior art. While these units may be suitable for the particular purpose to which they address, they would not be as suitable for the purposes of the present invention as heretofore described.

YATES, GEORGE H.

WINDSHIELD SCRAPER

U.S. Pat. No. 3,408,677

This invention is directed to a windshield scraper made from a sheet of uniform thickness of such gauge to provide a substantial working edge of abutting type as opposed to a knife edge. The stiffness of such a thick edge is greatly reduced by an adjacent parallel slot which forms connecting bridges at the sides. These bridges transmit hand pressure to concentrate at spaced points on the blade edge with curvature adaption flexibility therebetween.

THIELEMANN, RUDOLF H.

MULTIPURPOSE SKI TOOL

U.S. Pat. No. 3,816,863

A tool having a plastic body portion with side metal edges and a metal tip. The tip and the side metal edges are shaped to be usable as a screwdriver. The side metal edges can also be used as a scraper. The boy portion at the end opposite from the tip comprises a scraping edge. This latter edge is a part of the plastic body and can be used to scrape surfaces which metal may damage. The body portion is constructed of resin or plastic for structural and handling purposes.

PASCHETTO, PAUL E.

ICE SCRAPER

U.S. Pat. No. 5,099,540

An ice scraper is disclosed with multiple scraping surfaces. In the preferred embodiment, the scraper comprises a polygonal plastic plate with a central circular opening that acts as a handle, and a plurality of straight sides that form an octagon, wherein each of the sides has multiple sharp edges for scraping. This plurality of edges provides many working surfaces. Consequently, when one edge becomes dull, the invention need not be thrown away. Instead, it can be rotated, or flipped over, to use a new edge. In addition, because of the plurality of working edges, the user may scrape in a variety of directions without repositioning himself or realigning the scraper.

YOUNG, A. STEVEN

ICE SCRAPER-GAS NOZZLE TENDER

U.S. Pat. No. Des. 269,944

The ornamental design for an ice scraper-gas nozzle tender, substantially as shown.

SUMMARY OF THE INVENTION

Figure 1:
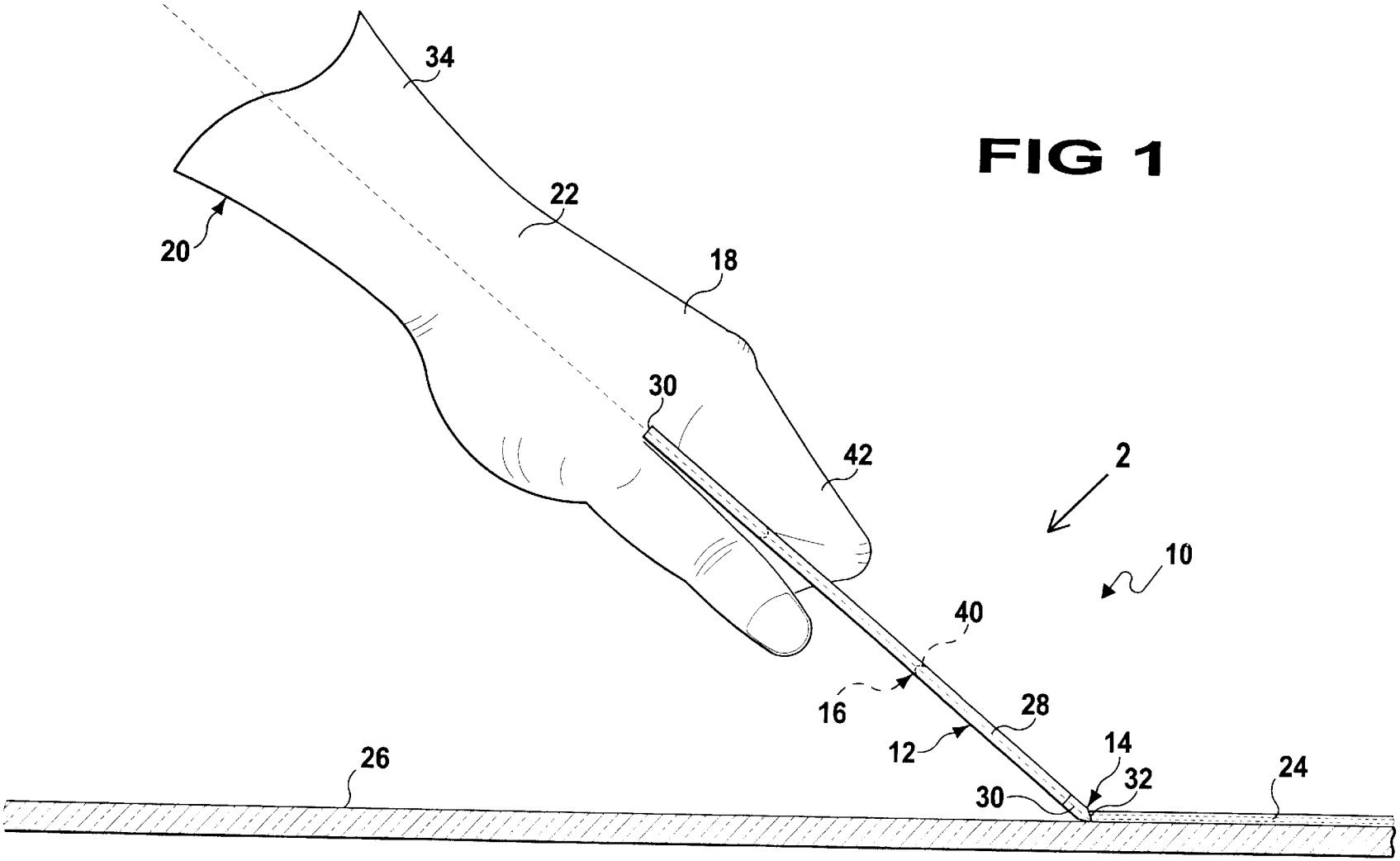
FIG. 1 is a top perspective view of an ice scraper-gas nozzle tender, showing the new design.

A primary object of the present invention is to provide a window ice scraper that will overcome the shortcomings of the prior art devices.

Another object is to provide a window ice scraper being a one-piece triangular shaped flat plate having a V-shaped scraping edge, which can be securely grasped by a hand of a person, so that it will reduce strain on the wrist of the person and effectively remove ice from a window.

An additional object is to provide a window ice scraper that is egronomically designed being of a small size, so it will fit in most glove boxes or under a seat in an automobile.

A further object is to provide a window ice scraper that is simple and easy to use.

A still further object is to provide a window ice scraper that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 1 is a side view of a first embodiment of the present invention being gripped by a hand of a person to remove ice from a window.

Figure 2:
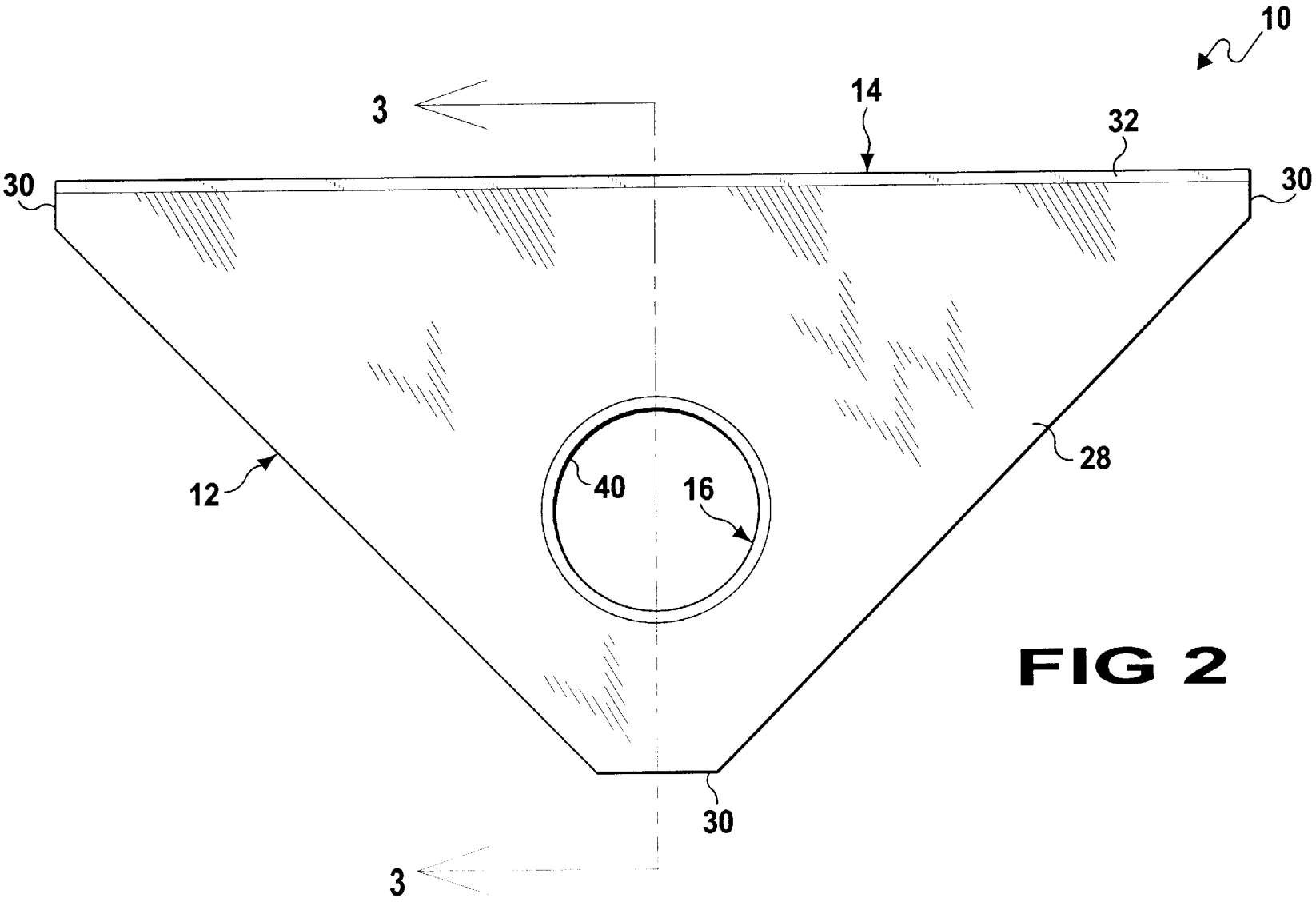
FIG. 2 is a bottom perspective view thereof.

FIG. 2 is a top plan view of the first embodiment per se taken in the direction of arrow 2 in FIG. 1.

Figure 3:
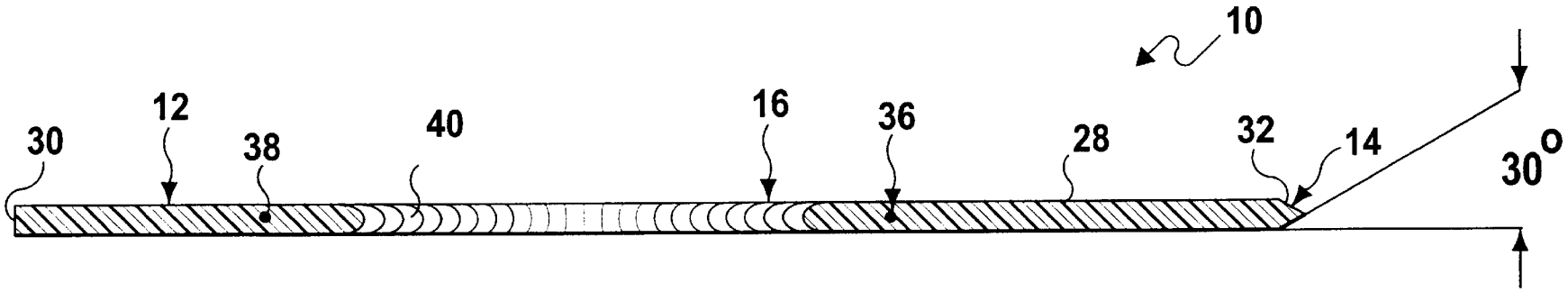

FIG. 3 is a cross sectional view taken along line 3—3 in FIG. 2.

Figure 4:
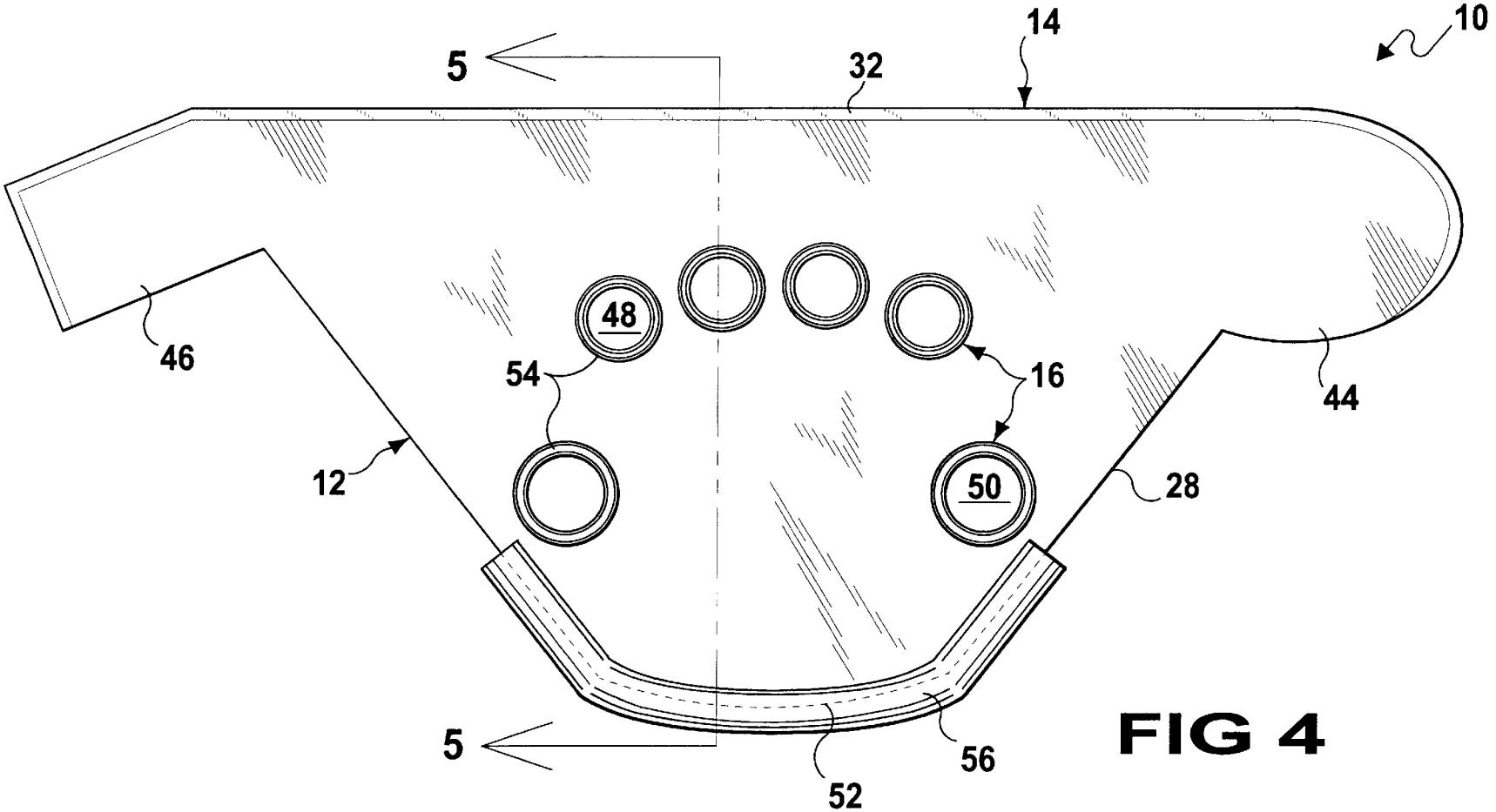

FIG. 4 is a top plan view of a second embodiment of the present invention.

Figure 5:
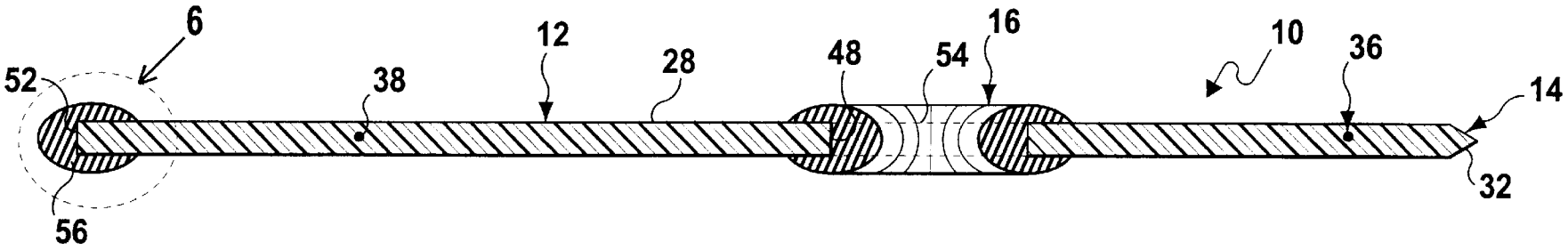

FIG. 5 is a cross sectional view taken along line 5—5 in FIG. 4.

Figure 6:
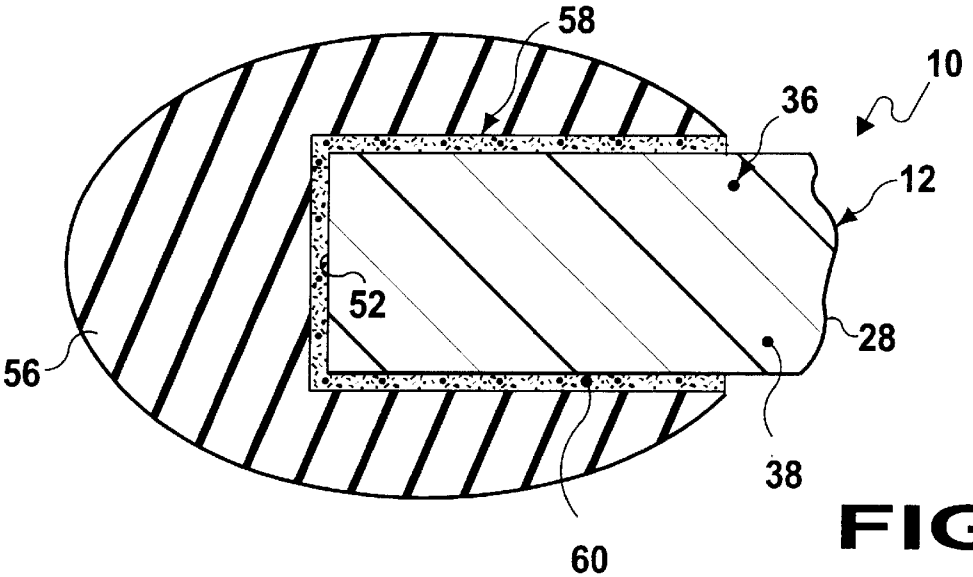

FIG. 6 is an enlarged cross sectional view of an area of FIG. 5 as indicated by arrow 6.

Similar reference characters denote corresponding features consistently throughout the attached drawings.

DETAILED DESCRIPTION OF THE PREFERRED EMBODIMENTS

Turning now descriptively to the drawings, in which similar reference characters denote similar elements throughout the several views, FIGS. 1 through 6 illustrate the present invention being a window ice scraper 10. With regard to the reference numerals used, the following numbering is used throughout the various drawing figures.

10 window ice scraper
12 one-piece flat plate of 10
14 scraping edge on 12
16 securely grasping facility of 10 in 12
18 hand of 20
20 person
22 wrist of 20
24 ice on 26
26 flat surface
28 triangular shaped body for 12
30 flattened corner on 28
32 V-shaped blade for 14
34 forearm of 20
36 non-metallic material for 12
38 weather-resistant thermoplastic substance for 36
40 enlarged circular aperture for 16 in 12
42 finger of 18
44 bulbous end of 12
46 square end of 12
48 finger opening for 16 in 12
50 thumb opening for 16 in 12
52 curved palm rest for 16 on 12
54 rubber sheathing ring of 16 in 48 and 50
56 rubber sheathing member of 16 on 52
58 attaching element of 16
60 adhesive material for 58

The window ice scraper 10 comprises a one-piece flat plate having a scraping edge 14. A facility 16 in the one-piece flat plate 12 is for securely grasping by a hand 18 of a person 20. It will reduce strain on the wrist 22 of the person 20, while the scraping edge 14 on the one-piece flat plate 12 can effectively remove ice 24 from a flat surface 26, such as a window in an automobile.

The one-piece flat plate 12 is a substantially triangular shape body 28, with the scraping edge 14 being the base of the triangular shaped body 28. The triangular shaped body 28, as best seen in FIG. 2, has three flattened corners 30 for safety use. The scraping edge 14 of the one-piece flat plate 12 is a V-shaped blade 32 having a third degree angle, which enables a direct line of force from a forearm 34 through the wrist 22 and the hand 18 of the person 20, to be applied directly to the one-piece flat plate 12 and the flat surface 26.

The one-piece flat plate 12 is fabricated out of a non-metallic material 36. The non-metallic material 36 is a weather-resistant thermoplastic substance 38. The securely grasping facility 16, as best seen in FIG. 2, includes the one-piece flat plate 12 having an enlarged circular aperture 40 therethrough, which allows a plurality of fingers 42 of the hand 18 of the person 20 to be inserted into the enlarged circular aperture 40 to allow the hand 18 of the person 20, to securely grasp the one-piece flat plate 12 in a comfortable manner.

The window ice scraper 10*a*, shown in FIGS. 4 through 6, is a second embodiment. The one-piece flat plate 12 contains a bulbous end 44 that extends outwardly from a first side of the scraping edge 14. A square end 46 extends outwardly from a second side of the scraping edge 14 which can be used for removing ice 24 from various tight areas, as well as irregular shaped areas, such as a rearview mirror and headlights in an automobile.

The securely grasping facility 16 consists of the one-piece flat plate 12 having four individual finger openings 48 and two thumb openings 50. Each thumb opening 50 is located on an opposite side from the finger openings 48, to allow either the right hand and the left hand of the person 20 to be used. A curved palm rest 52 is formed at an apex opposite from the scraping edge 14.

A plurality of rubber sheathing rings 54 and a rubber sheathing member 56 are provided. An element 58 is for attaching the rubber sheathing rings 54 within the finger openings 48 and the thumb openings 50 and the rubber sheathing member 56 along the curved palm rest 52, so as to cushion the hand 18 of the person 20. The attaching element 58 is adhesive material 60 (see FIG. 6).

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A window ice scraper comprising:

a) a one-piece flat plate having a scraping edge; and b) means in said one-piece flat plate, for securely grasping by a hand of a person, so that it will reduce strain on the wrist of the person, while said scraping edge on said one-piece flat plate can effectively remove ice from a flat surface, wherein said one-piece flat plate is a substantially triangular shaped body, with said scraping edge being a base of said triangular shaped body, and further wherein said one-piece flat plate includes a bulbous end extending outwardly from a first side of said scraping edge and a square end extending outwardly from a second side of said scraping edge which can be used for removing ice from various tight areas, as well as irregular shaped areas.

2. A window ice scraper as recited in claim 1, wherein said scraping edge of said one-piece flat plate is a V-shaped blade having a thirty degree angle, which enables a direct line of force from a forearm through the wrist and the hand of the person, to be applied directly to said one-piece flat plate and the flat surface.

3. A window ice scraper as recited in claim 1, wherein said one-piece flat plate is fabricated out of a non-metallic material.

4. A window ice scraper as recited in claim 3, wherein said non-metallic material is a weather-resistant thermoplastic substance.

5. A window ice scraper as recited in claim 1, wherein said securely grasping means includes said one-piece flat plate having four individual finger openings and two thumb openings, in which each said thumb opening is located on an opposite side from said finger openings, to allow either the right hand and the left hand of the person to be used and a curved palm rest formed at an apex opposite from said scraping edge.

6. A window ice scraper as recited in claim 5, wherein said securely grasping means further includes:

a) a plurality of rubber sheathing rings;

b) a rubber sheathing member; and c) means for attaching said rubber sheathing rings within said finger openings and said thumb openings and said rubber sheathing member along said curved palm rest, so as to cushion the hand of the person.

7. A window ice scraper as recited in claim 6, wherein said attaching means is adhesive material.

* * * * *